US008499978B2

(12) United States Patent
Dalchau et al.

(10) Patent No.: US 8,499,978 B2
(45) Date of Patent: Aug. 6, 2013

(54) WATER DISPENSER DEVICE AT DIFFERENT TEMPERATURES

(75) Inventors: Jean Carlos Dalchau, Joinville, SC (US); André Oliveira Pires, Joinville, SC (US); João Eduardo Santana Borges, Joinville, SC (US)

(73) Assignee: Whirlpool S.A., Sao Paulo (BR)

( * ) Notice: Subject to any disclaimer, the term of this patent is extended or adjusted under 35 U.S.C. 154(b) by 452 days.

(21) Appl. No.: 12/677,761

(22) PCT Filed: Sep. 9, 2008

(86) PCT No.: PCT/BR2008/000276

§ 371 (c)(1),
(2), (4) Date: Jun. 30, 2010

(87) PCT Pub. No.: WO2009/033242

PCT Pub. Date: Mar. 19, 2009

(65) Prior Publication Data

US 2010/0294804 A1 Nov. 25, 2010

(30) Foreign Application Priority Data

Sep. 11, 2007 (BR) ..... 0703807

(51) Int. Cl.
*B67D 7/08* (2010.01)

(52) U.S. Cl.
USPC ..... 222/146.1; 222/54

(58) Field of Classification Search
USPC ..... 222/146.1, 146, 2, 146.6, 146.5, 222/129.1–129.4, 52, 54, 280–282; 236/12.1, 236/12.11, 12.13
See application file for complete search history.

(56) References Cited

U.S. PATENT DOCUMENTS 3,785,492 A * 1/1974 Mazza ..... 210/149
4,693,415 A * 9/1987 Sturm ..... 236/12.12
4,792,059 A * 12/1988 Kerner et al. ..... 222/67

(Continued)

FOREIGN PATENT DOCUMENTS

DE 202004007196 U1 6/2004
EP 1584602 A 10/2005
WO 03064314 A 8/2003

OTHER PUBLICATIONS

International Search Report with Written Opinion, dated Aug. 5, 2009, received in international patent application No. PCT/BR2008/000276, 14 pgs.

*Primary Examiner* — Lien Ngo
(74) *Attorney, Agent, or Firm* — Brian J. Colandreo; Michael T. Abramson; Holland & Knight LLP

(57) ABSTRACT

A device receives water from a source (S), to be dispensed, by a single nozzle (18), in a container (R) at a final value of a plurality of temperature values. A first feed conduit (25*a*) is arranged between source (S) and includes a first heat exchanger (26) to cold water, yet been provided a second feed conduit (25*b*) and a third feed conduit (25*c*), this latter including a heat exchanger (46) which heats water. A control valve (24, 34, 44) is provided in each feed conduit (25*a*, 25*b*, 25*c*) and operated to supply water to the nozzle (18), at either conditions of cold water, normal water and hot water. Control valves (24, 34, 44) can be operated automatically, to dispense water at a predetermined temperature in a range defined from cold water to hot water.

15 Claims, 5 Drawing Sheets

U.S. PATENT DOCUMENTS 5,095,945 A * 3/1992 Jensen ..... 137/607
5,125,433 A * 6/1992 DeMoss et al. ..... 137/607
5,366,619 A 11/1994 Matsui et al.
5,551,630 A * 9/1996 Enoki et al. ..... 236/12.13
5,803,320 A * 9/1998 Cutting et al. ..... 222/641
5,889,684 A * 3/1999 Ben-David et al. ..... 700/282
6,164,189 A * 12/2000 Anson ..... 99/281
6,460,735 B1 * 10/2002 Greenwald et al. ..... 222/146.1
6,554,196 B2 * 4/2003 Sasayama et al. ..... 236/12.12
6,636,151 B2 * 10/2003 Busick ..... 340/521
6,669,053 B1 12/2003 Garson et al.
7,040,542 B2 * 5/2006 Hugger ..... 236/12.12
7,814,763 B2 * 10/2010 Tavolazzi et al. ..... 62/389
8,225,961 B2 * 7/2012 Anson ..... 222/54

* cited by examiner

WATER DISPENSER DEVICE AT DIFFERENT TEMPERATURES

CROSS REFERENCE TO PRIOR APPLICATIONS

This application is a US National Phase Application under 35 U.S.C. §371 of International Patent Application No. PCT/BR2008/000276 filed Sep. 9, 2008, which claims priority to and the benefit of Brazilian Patent Application No. PI0703807-0, filed Sep. 11, 2007, each of which are hereby incorporated by reference in their entireties. The International Application was published in English as WO 2009/033242 on Mar. 19, 2009.

FIELD OF THE INVENTION

The present invention refers a device for dispensing water, at different temperatures, inside a container and through a single nozzle.

BACKGROUND OF THE INVENTION

Cold water dispensers devices are well known in the art. Such types of device include an independent cooler of water, a refrigerator or a combined refrigerator-freezer that presents a single nozzle to dispense water that is refrigerated by a heat exchanger device, such as a cooling coil inside the refrigerator appliance.

FIG. 1 of the accompanying drawings shows a conventional device of prior art, in the form of a refrigerator 10 having a cabinet 12 and a door 14 that is mounted at the cabinet by hinges (not shown). The door 14 presents, typically, a recess 16 within which a nozzle 18 is mounted. It is further provided an on-off type electric switch SW, to which a voltage is applied from a source, inside the appliance, by means of a conductive line 2. The electric switch SW can be placed inside the recess 16 of the refrigerator door 14 and can be constructed in the shape of a plate type switch that is actuated, when pressure is applied against it, by a container or even directly by the user's hand. The electric switch SW can be also of the manually operated type. Other interrupters can also be mounted in the refrigerator door 14, to control ice cubes or ground ice dispensers devices.

As FIG. 1 shows, water, at normal or room temperature, is supplied from a source S, such as a residential hydraulic system, through a first inlet conduit 21, to a water filter 22. Filter 22 can be located externally to cabinet 12 of the refrigerator appliance, in order to be easily changed or repaired. The filter outlet 22 is conducted, through a second inlet conduit 23 and a control valve 24, usually of the solenoid type, to a heat exchanger inlet 26 that can take the shape of a cooling coil, of adequate dimension and configuration, to cool water, the said cooling coil can be positioned properly inside the cabinet 12 of the refrigerator appliance, to the water be cooled by the internal temperature in said cabinet 12. The heat exchanger outlet 26 is connected to the door 14 nozzle 18 by means of an outlet conduit 28. The first and second inlet conduits 21 and 23 and the outlet conduit 28 are generally formed of flexible material, wherein the outlet conduit 28 can be arranged through one of the hinges responsible for the door 14 assembly at the cabinet 12.

When utilizing the device illustrated in FIG. 1, an user positions a container R, such as a glass, cup or mug, inside recess 16 of door 14, moving container R against electric switch SW. This procedure closes an electrical circuit to supply voltage to the control valve 24, to open it. This causes water from the filter 22 to be supplied to the heat exchanger 26 to be cooled, and for water so cooled be then supplied to the nozzle 18, to be dispensed inside container R arranged under said nozzle 18. Cold water is dispensed inside container R during time electric switch 1 is kept depressed. In some types of refrigerators, control valve 24 is located between heat exchanger 26 outlet side and the nozzle 18. Yet in some instances, it is provided a reservoir (not shown) for the cold water, arranged upstream control valve 24.

In some cases, the user of the device wants to have available water at different temperatures other than cold water. For instance, user can wish water available at normal or room temperature, supplied from the water source S, hot water for a drink such as tea, or water at a temperature between cold water and hot water. These functions can not be achieved with prior art devices of the type shown in FIG. 1. So, it is desirable to provide a device with an arrangement that allows the supply of water at different temperatures and through a single nozzle.

SUMMARY OF THE INVENTION

An appliance, such as a refrigerator, receives water from a supply source, such as the supply of residential water at normal or room temperature. Room temperature water is provided from a plurality of feed conduits, each of which associated to a control valve, such as, for example, an electrically operated control valve, having a individual and independent body for each feed conduit or a single body provided with a inlet to be connected to the supply source and two or three outlets connected, each, to a respective feed conduit. Control valves can still be optionally built in a single body having two or three inlets and an outlet guiding to a single nozzle. When in an open condition, the control valve outlet, associated with a feed conduit, supplies water, at room temperature, to a first heat exchanger that cools water. Control valve outlet associated with a second feed conduit, when is open, supplies water at room temperature, to a second heat exchanger that heats water. Control valve outlet to a third feed conduit, when is open, supplies water at room temperature. An outlet connection is further provided, to which the three feed conduits outlet ends are connected, wherein this outlet connection presents a single outlet that is connected to a single nozzle.

In an embodiment of the invention, electric switches, manually operatable, allow device user to open, selectively, control valve associated to either feed conduits, to then cause the release, to the single nozzle of a amount of either cold, room or normal and hot water. By adequate operation of selector electric switches, user can obtain all desired water at a single temperature or still produce a blend of water in the container at two or more of the available temperatures, to then achieve any water temperature from cold water to hot water. In other embodiment of the invention, there are provided selector electric switches in a circuit that operates the control valves for, automatically, dispense water through the single nozzle, to the container R, at a temperature selected from a plurality of predetermined temperatures from cold water to hot water.

According to yet other embodiment of the invention, a microprocessor is programmed to operate the control valves to discharge, through the single nozzle and into the container, water at any temperature selected by the user, from cold water to hot water, and in an amount that can be predetermined or defined by the activation time of the device by the user.

BRIEF DESCRIPTION OF THE DRAWINGS

Other objectives and advantages of the present invention will be better understood, making reference to the specification defined ahead and to the accompanying drawings, given as examples of possible embodiments of the invention and in which.

DETAILED DESCRIPTION OF THE INVENTION

Figure 1:
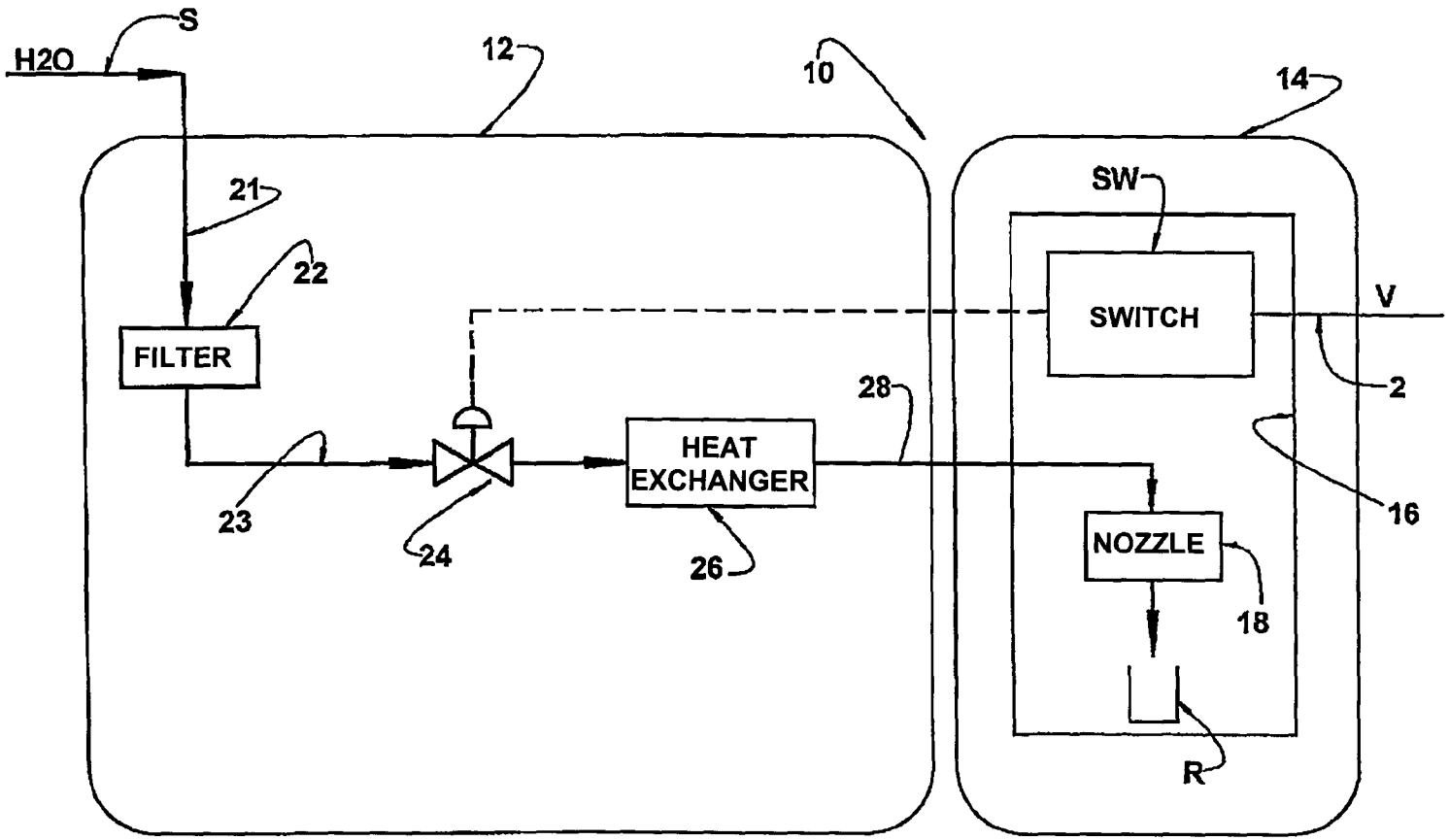
FIGURE 1 PRIOR ART
FIG. 1 is a schematic diagram of a prior art device, designed to supply only cold water.
Figure 2:
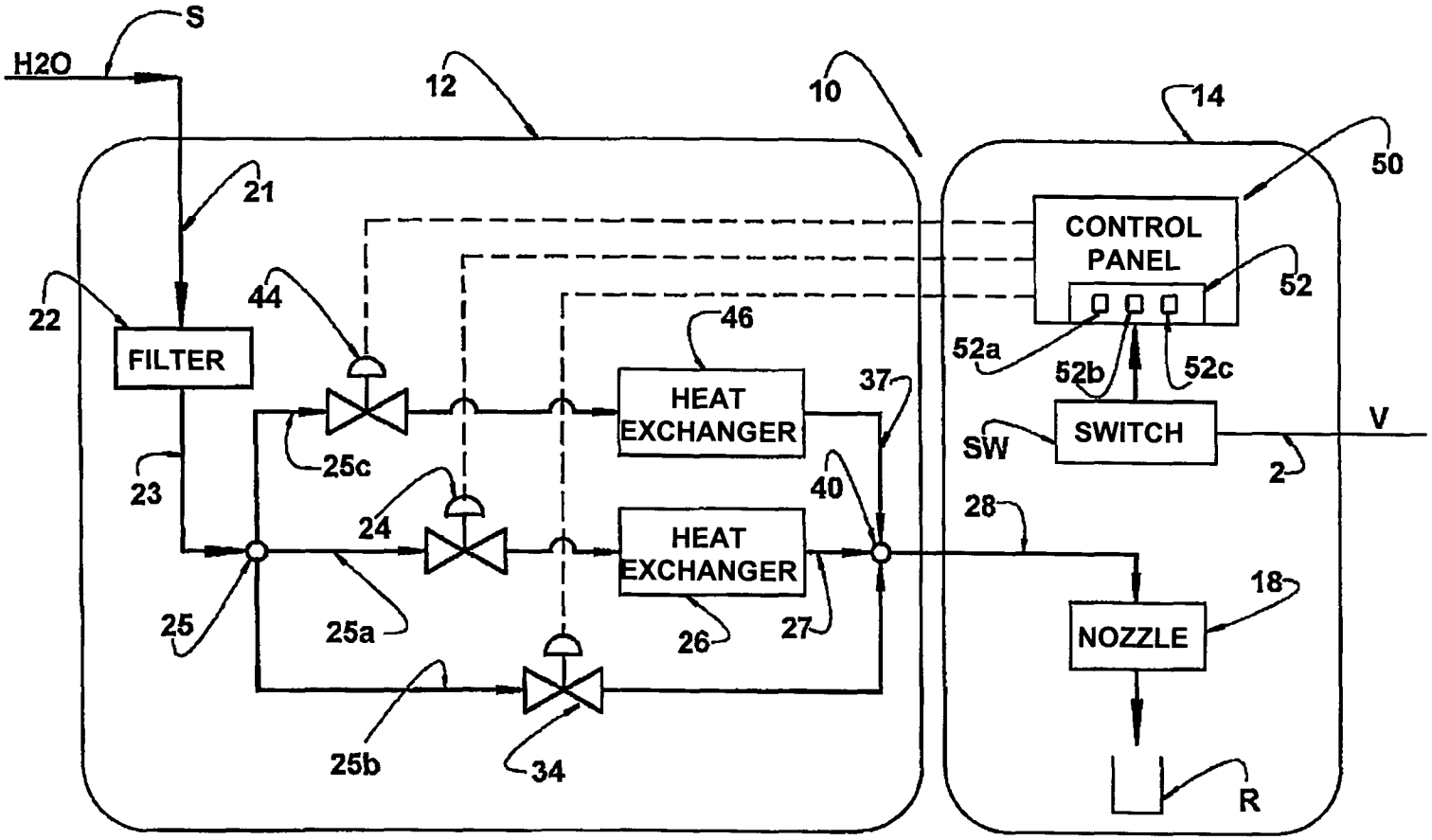
FIG. 2 is a schematic diagram of a device according to the invention, to supply water through a single nozzle in any temperatures defined by cold water, normal water or hot water, as per selected by the user.

Referring to FIG. 2, it is shown the first embodiment of the invention to dispense selectively either cold water, or water at room temperature or hot water through a single nozzle. The same reference numbers are used for the same elements shown in FIG. 1.

Water from fresh water source is supplied, at room temperature, by a first inlet conduit 21, to the filter 22, the outlet of which is coupled to a second inlet conduit 23 that is connected to the single inlet of an inlet connection 25. One of the outlets of the inlet connection 25 is applied to the inlet of a first feed conduit 25*a* that carries a first control valve 24, the outlet of which is supplied to the inlet of a first heat exchanger 26 for water cooling. The heat exchanger outlet 26 is applied, by means of a conduit 27, to an inlet of an outlet connection 40 that has a single outlet connected, by the outlet conduit 28, to the nozzle 18.

Another outlet of the inlet connection 25 is applied to the inlet of a second feed conduit 25*b* that carries a second control valve 34, and the outlet of which is connected to a second inlet of the outlet connection 40. A third feed conduit 25*c* is connected to an outlet of the inlet connection 25 and carries a third control valve 44, the outlet of which is connected to the inlet of a second heat exchanger 46, the outlet of which is guided to any of the first and second inlets of the outlet connection 40. The second heat exchanger 46 receives water at room temperature when the third control valve 44 is open and heats water at a temperature that is rather lower than the boiling temperature. Hot water is supplied, by a conduit 37, to an inlet of the outlet connection 40. The second heat exchanger 46 can be defined by an electrically operated heating coil or yet, for instance, receiving heat from a refrigerator own condenser.

It should be noted here that the first and the third control valves 24, 44 can be placed between the respective first and second heat exchangers 26, 46 and the nozzle 18, as per already mentioned before regarding the construction of prior art, shown in FIG. 1.

An on-off type electric switch SW is mounted at the door 14 and receives voltage V from a source not shown. An electric switch SW can be of the plate type or can be an on-off manually operated push button type switch, a doggle type electric switch or other conventional electric switch. The electric switch SW is mounted in series with a selector switch 52 in a control panel 50. The selector switch 52 presents three switch sections 52*a*, 52*b* e 52*c* that are preferably of push-button type or lever operated type. The actuation of each switch section 52*a*, 52*b* e 52*c*, when electric switch SW is closed, supplies voltage operational to one of first, second and third control valves 24, 34, 44, to actuate it from a closed condition to an open condition, so that water from the source S can flow through the valve and be guided to the nozzle 18. So, the operation of one of the switch sections 52*a*, 52*b* e 52*c* determines whether cold, normal or hot water will be dispensed through the nozzle 18.

Considering the embodiment of FIG. 2, if the user desires to dispense cold water through the nozzle 18, he operates the electric switch SW, for instance, pushing a container R against said switch, to cause voltage to be applied to the switch sections 52*a*, 52*b* and 52*c*. The user operates switch section 52*a* that causes the first control valve 24 to be open and water can flow from filter 22 to the second inlet conduit 23, through inlet connection 25, first control valve 24 open, first heat exchanger 26, conduit 27 and outlet connection 40 and to the inside of outlet conduit 28, to be dispensed in container R through the nozzle 18. The user actuates the switch section 52*b* to obtain water at normal or room temperature. This causes voltage to be applied to the second control valve 34. When a second control valve 34 is open, water flows from the second inlet conduit 23, at the filter outlet 22, through the inlet connection 25, second control valve 34 open, through the outlet connection 40 and the outlet conduit 28, to the nozzle 18.

When the user wants to have hot water, he operates switch section 52*c*. This operation causes third control valve 44 to be open, so that water can flow from filter 22, through inlet connection 25 and third control valve 44, into inside the second heat exchanger 46. Hot water at the outlet of the second heat exchanger 46 flows through conduit 37 and outlet connection 40, to the outlet conduit 28, to be dispensed through the nozzle 18, inside the container R. As can be seen, the device user has the option to select water in three different temperatures, to be dispensed through a single nozzle 18.

In an alternate embodiment other than FIG. 2, an on-off type, electric switch SW, can be eliminated and each section of the selector switch 52 can be of on-off type, that is, of the pole-single throw type, which is connected between voltage source and one of said control valves 24, 34 e 44. When a switch section 52*a*, 52*b* and 52*c* is actuated, an electrical connection is achieved with respective control valve connected to respective switch section, to operate control valve 24, 34 or 44 and this way supply either cold water, or normal temperature water, or even hot water to the nozzle 18.

Amounts of water in each of two or three temperatures available can be supplied to the nozzle 18 to be mixed in container R, below nozzle 18, by means of manual operation of two or three switch sections 52*a*, 52*c* e 52*b*. This procedure can provide water in container R at any temperature within the range from cold water to hot water. If the conduits of water feed present enough flow capacity, two or more of switch sections 52*a*, 52*b*, 52*c* can be operated at the same time, to dispense water at a temperature defined from a temperature of cold water to a temperature of hot water.

Figure 3:
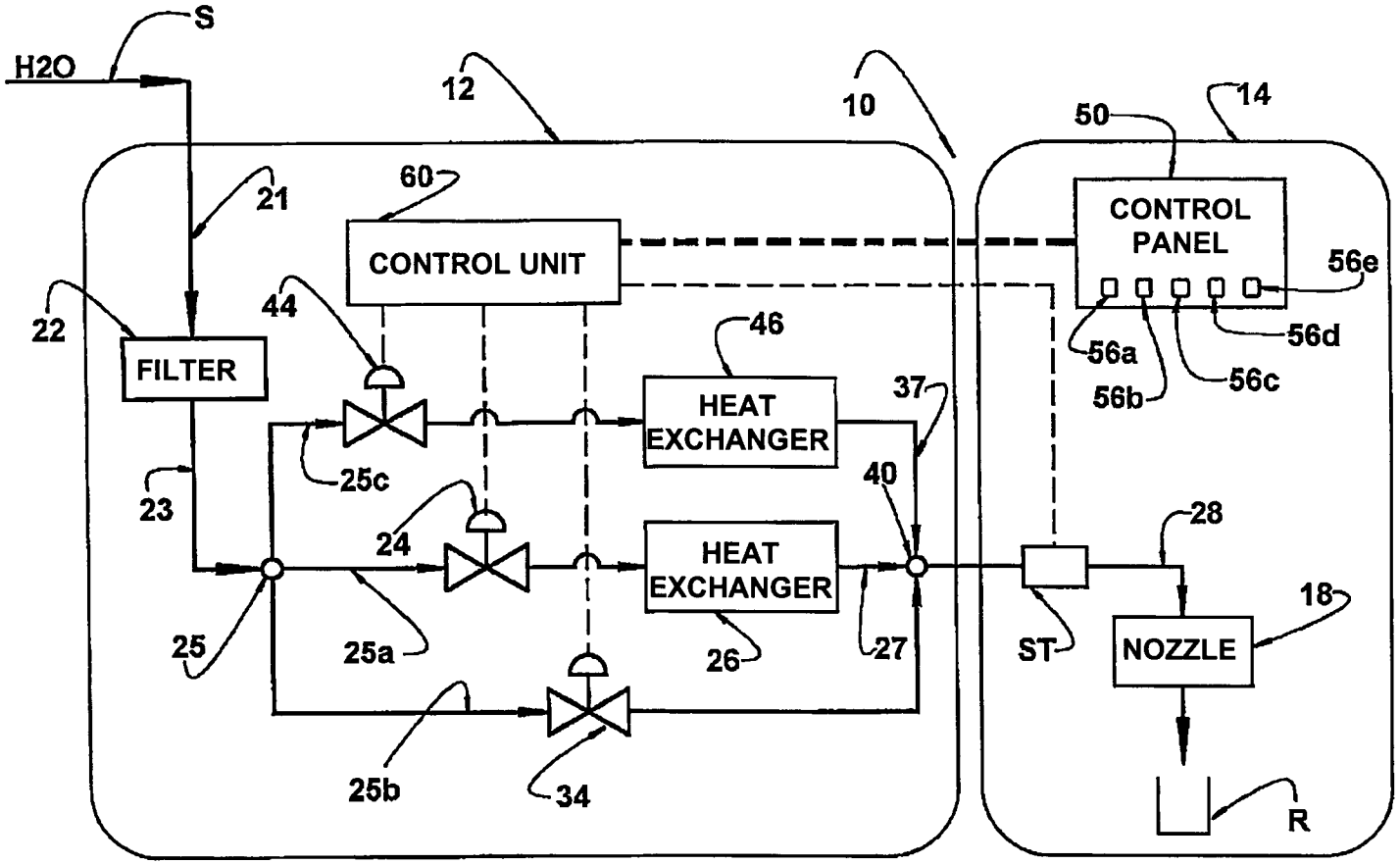
FIG. 3 is a schematic diagram of a device according to the invention, to supply water at a plurality of predetermined different temperatures through a single nozzle.

FIG. 3 shows a second embodiment of the invention, in which water can be dispensed through the single nozzle 18, automatically, in a plurality of predetermined different temperatures selectable by the user. Here, again, the same reference numbers are used for the same elements previously described. In this second embodiment, the control panel 50 is provided with a plurality of switches mounted illustratively as being five in number and designed by 56*a*, 56*b*, 56*c*, 56*d* e 56*e*. The purpose of switches 56*a* to 56*e* is allow user to achieve a final temperature of water to be dispensed in container R through a single nozzle 18, final temperature of which can be either temperature of cold water, normal water or hot water or yet various temperatures between cold water and hot water. In an example of this second embodiment of the invention, the driving of the switch 56*a* will cause release of only 100% of cold water in the container R, whereas the driving of the switch 56*b* will release a blend of 50% cold water and 50% water at room temperature. The driving of the switch 56*c* will cause release of 100% of water at normal or room temperature and the driving of switch 56*c* will release a blend of 50% hot water and 50% water at normal or room temperature. The driving of switch 56*e* will cause release of 100% of hot water. Switches 56*a* to 56*e* shall be provided in any desired number, each having its own predetermined designation of water in each of temperatures of cold water, normal water and hot water to be released into the inside of container R.

Figure 3A:
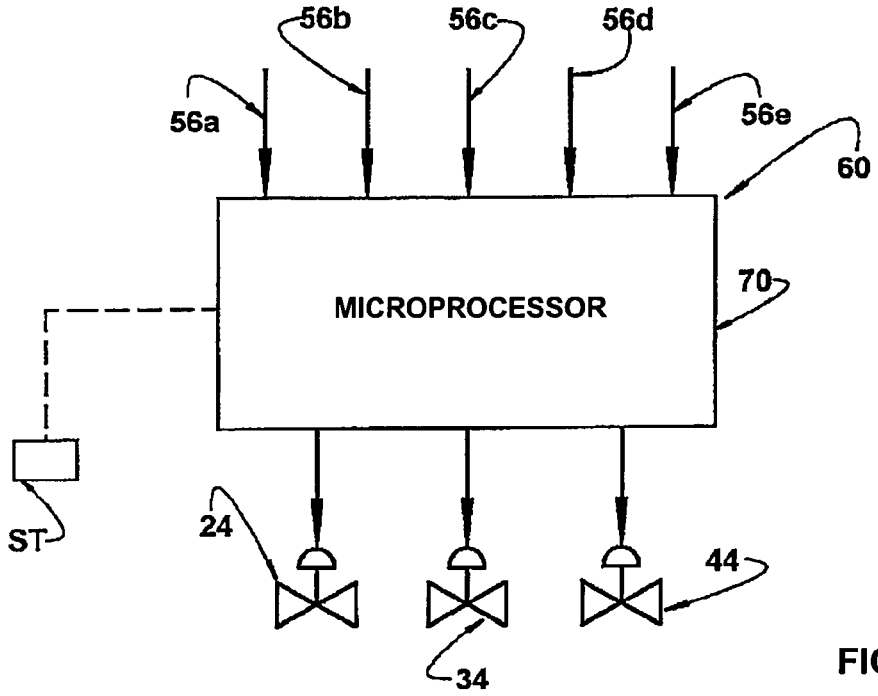
FIG. 3A is a schematic diagram of a circuit to operate device of FIG. 3, to make it dispense water automatically in a container, at a final temperature value defined from a plurality of predetermined temperatures ranging from cold water to hot water.

According to embodiment of FIG. 3, a control unit 60 is provided to house the components of a circuit, such as that shown in FIG. 3*a*. Control unit 60 includes a microprocessor 70 which is usually available in refrigerator. Microprocessor 70 has inlet controls from switches 56*a*-56*e* and outlets which control the application of voltage operational to first, second and third control valves 24, 34 and 44. Microprocessor 70 is programmed to answer differently to the actuation of each switch 56*a*-56*e*, depending on the temperature of water to be dispensed in one or more of the temperatures of cold water, room or normal water and hot water. For instance, when switch 56*a* is actuated by user, microprocessor outputs outlet at conductive line that applies voltage to the first control valve 24, so that only cold water is dispensed by the nozzle 18. Actuation of switch 56*c* causes the microprocessor 70 to actuate second control valve 34, so that only water at normal or room temperature is dispensed, while user remains actuating the respective switch. Actuation of switch 56*e* causes microprocessor 70 to output an output signal at the line which controls third control valve 44, so that only hot water be dispensed in the container R arranged below the nozzle 18.

When one of the switches 56*b* or 56*e* is actuated, the program in microprocessor 70 outputs signals in two or more of its output lines to control the actuation of two or more control valves 34, 34 e 44, to dispense water at different temperatures from the nozzle 18, providing a blend at a predetermined temperature in container R. Actuation of control valves, in response to the actuation of one of the switches 56*b* or 56*d*, can be simultaneous or alternate by time periods, interlaced in a given frequency defined by microprocessor 70, so that water pulses in each of different temperatures are released by control valves and dispensed from nozzle 18 into the interior of container R.

Figure 3B:
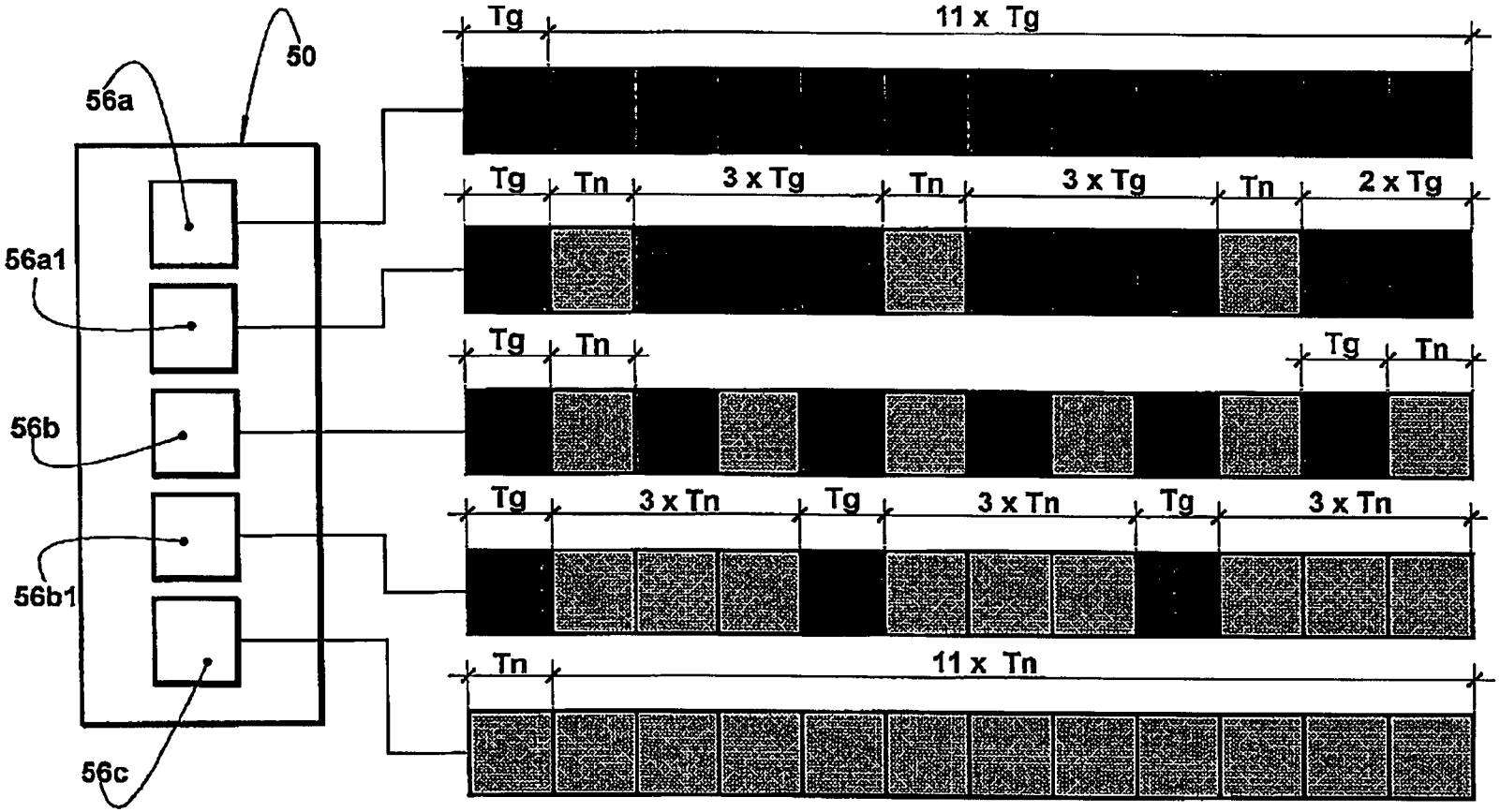
FIG. 3B represents a schematic view of control panel, showing an arrangement of switches to the selection of water temperature, from cold water to normal water, to be released by the nozzle, each switch being associated with a respective diagram representative of opening pulses pattern of the control valves involved.

FIG. 3B represents an exemplificative diagram of different conditions operational of the pair of control valves 24 and 34 related to the release of cold water and normal water (at room temperature), respectively. It should be understood that the following description is equally applicable to pair of control valves 34, 44, related to the release of normal water and hot water, respectively.

FIG. 3B illustrates, schematically, a control panel 50 that can be of the type shown in FIG. 3, but having five different switches 56*a*, 56*a*1, 56*b*, 56*b*1 and 56*c* for the actuation of the first control valve 24, for cold water, together with second control valve 34 for normal water.

For the operation of second control valve 34 for normal water together with third control valve 44 of hot water, it would be then provided other switches (not shown) which shall be in the same number as the firsts or just represented by switches 56*d* and 56*e* of control panel 50 in FIG. 3.

Switches 56*a*, 56*a*1, 56*b*, 56*b*1 e 56*c* illustrated in FIG. 3B represent, respectively, the followings releases of water by the nozzle 18:

Switch 56*a*—100% cold water;
Switch 56*a*1—75% cold water and 25% normal water;
Switch 56*b*—50% cold water and 50% normal water;
Switch 56*b*1—25% cold water and 75% normal water;
Switch 56*c*—100% normal water.

Figure 4:
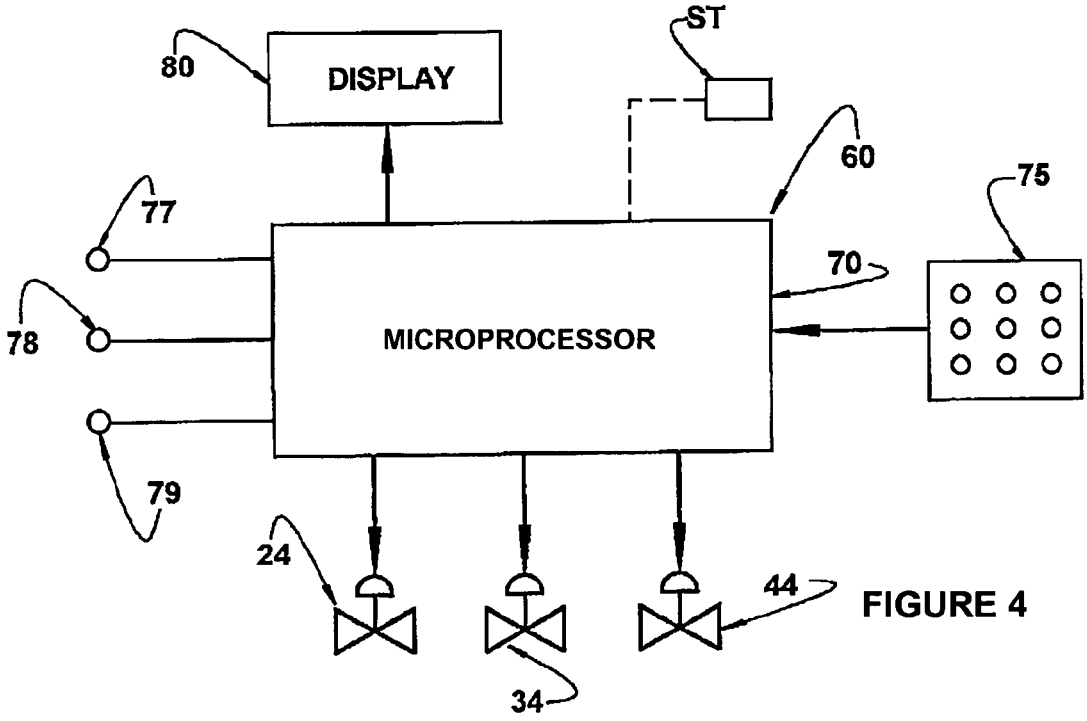
FIG. 4 is a schematic diagram of a circuit to operate FIG. 3 device, to dispense water automatically, in a container, at a final temperature selected from cold water to hot water and at a pre-selected amount by the user or defined by the time the latter remains actuating the device.

When switch 56*a* is directly selected in the control panel 50 or through keyboard 75 at the construction of FIG. 4, to obtain a determined temperature of released water by the nozzle 18, second control valve 34, relative to the release of normal water, will not be actuated, whereas first control valve 24 will be open in sequential pulses, each opening pulse having a predetermined duration time Tg. The opening pulses are kept, while user remains actuating the device or, optionally, until a predetermined amount of water be achieved by user.

The selection of switch 56*a*1, by user, allows the device, when actuated, to instruct first and second control valves 24, 34 of the pair in question to open pursuant pulses pattern denoted in the respective diagram and that comprises an initial opening pulse of time Tg of first control valve 24 of cold water, followed by an opening pulse with a time Tn of second control valve 34 of normal water. Afterward, the device operation is continued, until the desired water quantity is achieved, in a pattern of three opening pulses of time Tg, for the first control valve 24 of cold water, interlaced with an opening pulse, of time Tn, for the second control valve 34 of normal water.

The selection of switch 56*b* will produce an operation wherein each opening pulse, of time Tg, of first control valve 24 of cold water is followed by an opening pulse, of time Tn, of second control valve 34 of normal water, the time pulses Tg and Tn being interlaced to release, usually, equal quantities of cold water and normal water.

The selection of switch 56*b*1 by user will produce a pattern of opening pulses similar to that described in relation to the selection of switch 56*a*1, but with each two consecutive opening pulses, of time Tg, of first control valve 24 of cold water being interlaced by three continuous pulses, of time Tn, of opening of second control valve 34 of normal water.

At last, the selection of switch 56*c* will not produce opening pulses of first control valve 24 of cold water, but only sequential opening pulses, of time Tn, of control valve 34 of normal water. In this case, only normal water will be released by the nozzle 18.

It should be understood that the number of opening pulses of control valves will depend on the time that the device remains operating to release the desired quantity of water. Thus, the twelve pulses of time Tg and Tn illustrated in diagrams in FIG. 3B should be considered only by way of example, since the number of pulses is usually greater.

Considering the differences in charge loss in the paths of cold water and normal water, the duration time Tg of opening pulses of first control valve 24 of cold water corresponds to the value of duration time Tn of opening pulses of second control valve 34 of normal water, added by a predetermined value because of constructive characteristics of device and that allows both first and second control valves 24, 34 release the same quantity of water to the nozzle 18, in each of respective opening pulses.

It should be understood that the same operational characteristics can be applied for the operation of third control valve 44 of hot water in association with a second control valve 34 of normal water.

In an alternative form, microprocessor 70 is programmed to operate control valves until a predetermined quantity of water is dispensed of nozzle 18 into the interior of container R, by actuation of each switch 56*a*-56*e* by user.

FIG. 4 shows a modification in circuit used in the control unit 60. In this case, a keypad is provided 75 to supply inputs to microprocessor 70, wherein the switches 56*a*-56*e* are not used. The user presses a key 77 that actuates the microprocessor to receive instructions about water temperature, in Fahrenheit degrees or in Centigrade degrees, according to the program, to be dispensed and the user types a desired temperature using the keypad 75. The temperature data input by user are shown in a display 80. In the illustrated construction, the device further includes, optionally, a key 78 that allows user, upon pressing it, to prepare the microprocessor 70 to receive instructions about the water quantity, in ounces, grams or milliliters, according to the programmed, to be dispensed by the nozzle 18. User types the desired quantity, which is shown on the display 80. Microprocessor 70 is programmed to answer the instructions of temperature and, optionally, of quantity, to output signals in one or more output lines that control actuation of first, second and third control valves 24, 34 and 44 for the required periods to achieve the dispensing of water in one or more conditions of temperature of cold water, room or normal water or hot water, so that water in the selected temperature and quantity is dispensed inside container R. Afterward, user presses a start key 79. This operation cause microprocessor 70 to process instructions as described, so that water in selected temperature and, optionally, quantity, is dispensed through the nozzle 18, inside container R.

It should be understood that, when there is not pre-selection of quantity, that is, utilization of key 78 for instruction of quantity, the quantity of released water by the nozzle will be defined by the time of actuation from user on the key 79.

Even though not illustrated in the accompanying drawings, it should be understood that the first, the second and, optionally, the third control valves can be formed in a single valve body of construction well known in the art and can be built with an inlet to be connected to the source S and two or three outlets to be connected, respectively, to first, second and, optionally, third feed conduits 25*a*, 25*b* and 25*c*. Such a type of valve construction is made and available in Brazil by "Invensys Appliance Controls", under the denomination "válvula de áqua de três vias".

In the case the control valves are mounted downstream respective first and second heat exchangers 26, 46, a construction in single body will be that one that presents two or, optionally, three inlets to be, respectively, connected to first, second and, optionally, third feed conduits 25*a*, 25*b*, 25*c* and an outlet to be connected to the nozzle 18.

In the construction of single body control valves above mentioned, said valve single body begin to exert the function of inlet connection 25 or outlet connection 40.

As illustrated in FIG. 3, when using a microprocessor 70 in a control unit 60 to operate automatically the control valves based on the commands effectuated by user, the dispenser device in question can further comprise a temperature sensor ST provided on the outlet conduit 28 and operatively associated to the microprocessor 70, in order that this latter can operate said first, second and, optionally, third control valves 24, 34, 44 also based on water temperature being discharged to the nozzle 18. The provision of at least one temperature sensor allows the device fit the automatic operation of control valves based on the variations of water temperature from the source S and yet on thermal exchange temperature acquired on the heat exchangers.

As can be observed, the present invention provides a device that can dispense water at different temperatures through a single nozzle 18. The operation of the water dispenser system is simple and the additional costs to achieve the aggregate functionality are reasonable.

Specific aspects of the invention are shown in one or more of the drawings only for convenience, because each aspect can be combined with other aspects according to the invention. Alternatives embodiments will be envisioned by experts in the art and must be included inside the scope of claims. So, the above description should be understood as illustrative and not limitative of the protection scope of the invention. All obvious changes and modifications should be considered as lying inside the patentable scope, defined in the claims that accompany the present specification.

The invention claimed is:

1. A water dispenser device at different temperatures inside a container comprising:

a nozzle through which water is configured to dispense;

a first feed conduit having an inlet configured to receive water from an external source at a first temperature and an outlet configured to connect to said nozzle;

said first feed conduit including a first heat exchanger configured to cool water to a second temperature and configured to connect in series with a first control valve that, when open, allows water, at said second temperature, to be discharged from said outlet of said first feed conduit to said nozzle;

a second feed conduit including an inlet configured to receive water at a first temperature from the external source and an outlet configured to connect to said nozzle, said second feed conduit configured to connect in series with a second control valve that, when open, allows water at said first temperature to be discharged from said outlet of said second feed conduit to said nozzle;

a selector switch configured to open one of said first and second control valves, to selectively supply water to said nozzle at one of said first and second temperatures;

a temperature sensor provided at an outlet conduit and operatively associated to a microprocessor to operate said first and second control valves based on water temperature charged to the nozzle;

wherein said first and second control valves are configured to electrically operate; and wherein said selector switch comprises a switch section configured to manually operate, to apply, selectively, a voltage operational to each of said first and second control valves;

wherein said selector switch comprises a plurality of electric switches, each corresponding to a predetermined water temperature defined by a value ranging from first to second temperatures, to be dispensed inside said container, said water dispenser device further comprising a control unit responsive to actuation of one of said electric switches configured to open said first and second control valves, one of simultaneous and alternately, in a predetermined frequency by control unit to supply a total water quantity to said nozzle, to be dispensed inside said container at a predetermined temperature, corresponding to said actuated electric switch; and wherein said control unit comprises the microprocessor configured to operate at least one of said first and second control valves to be open by at least one predetermined time period, corresponding to said actuated electric switch.

2. The water dispenser device, according to claim 1, wherein said first and second control valves are formed in one valve body provided with an inlet configured to connect to the source and two outlets respectively configured to connect to the first and second feed conduits.

3. The water dispenser device, according to claim 1, wherein said first and second control valves are formed in one valve body provided with two inlets respectively configured to connect to the first and second feed conduits and one outlet configured to connect to the nozzle.

4. The water dispenser device, according to claim 1, wherein said device further comprises:

an inlet device configured to supply program data to said microprocessor and relative to quantity and final temperature of water to be dispensed by the nozzle inside said container, wherein said microprocessor is configured to operate said first and second control valves opening them, alternately, in a frequency defined by said microprocessor and for a predetermined time, to dispense a final quantity of water in said container, at predetermined temperature and quantity.

5. The water dispenser device, according to claim 4, further comprising a temperature sensor provided at an outlet conduit and operatively associated to the microprocessor, to operate said first and second control valves based on water temperature discharged to the nozzle.

6. The water dispenser device, according to claim 1, further comprising:

an inlet device configured to supply program data to said microprocessor and relative to quantity and final temperature of water to be dispensed by the nozzle inside said container, wherein said microprocessor is configured to operate said first and second control valves opening them, alternately, in a frequency defined by said microprocessor and for a time that user remains actuating inlet device, to dispense a final quantity of water in said container, at predetermined temperature and quantity controlled by said user.

7. The water dispenser device, according to claim 1, further comprising:

a third feed conduit having an inlet configured to receive water from a said external source at said first temperature from a said source and an outlet configured to connect to said nozzle, said third feed conduit including a second heat exchanger configured to heat water at a third temperature and configured to connect in series with a third control valve which, when open, allows water at said third temperature to be supplied from said outlet of said third feed conduit to said nozzle;

wherein said selector switch is configured to operate to open of said first, second and third control valves to supply water selectively to said nozzle through one of said first, second and third feed conduits, respectively, at first, second and third temperatures; and wherein said first, second and third control valves are configured to electrically operate, and wherein said selector switch comprises a switch section configured manually operate to apply, selectively, a voltage operational to each of said control valves.

8. The water dispenser device, according to claim 7, wherein said selector switch further comprises a plurality of electric switches, each corresponding to a predetermined water temperature selectable from a value corresponding to first temperature to a value corresponding to third temperature, to be dispensed inside said container, said water dispenser device further comprising a control unit responsive to actuation of one of said electric switches configured to open one or more of said first, second and third control valves, one of simultaneous and alternately at a predetermined frequency by said control unit, to supply a total quantity of water to said nozzle, to be dispensed inside said container at a predetermined temperature and corresponding to the actuated electric switch.

9. The water dispenser device, according to claim 8, wherein said control unit comprises a microprocessor configured to operate one or more of said first, second and third control valves to be open for at least a predetermined time corresponding to the actuated electric switch.

10. The water dispenser device, according to claim 9, further comprising a temperature sensor provided at an outlet conduit and operatively associated to the microprocessor, to operate said first, second and third control valves, based on water temperature discharged to the nozzle.

11. The water dispenser device, according to claim 7, further comprising:

an inlet device, configured to be actuated by a user, to supply program data to said microprocessor relative to quantity and final temperature of water to be dispensed by said nozzle inside said container, wherein said microprocessor is configured to operate one or more of said first, second and third control valves opening them alternately, in a frequency defined by said microprocessor and for a predetermined time to dispense a final quantity of water inside said container, at programmed quantity and temperature.

12. The water dispenser device, according to claim 11, further comprising a temperature sensor provided at an outlet conduit and operatively associated to the microprocessor, to operate said first, second and third control valves, based on water temperature being discharged to the nozzle.

13. The water dispenser device, according to claim 7, further comprising:

an inlet device, to be actuated by a user, to supply program data to said microprocessor relative to final temperature of water to be dispensed by said nozzle inside said container, wherein said microprocessor is configured to operate said first, second and third control valves opening them alternately, in a frequency defined by said microprocessor and for a time that said user remains actuating the inlet device, to dispense a final quantity of water in said container, at predetermined temperature and quantity controlled by said user.

14. The water dispenser device, according to claim 7, wherein said first, second and third control valves are configured to form in a valve body provided with an inlet configured to connect to the source and three outlets configured to connect respectively to the first, second and third feed conduits.

15. The water dispenser device, according to claim 7, wherein said first, second and third control valves are configured to form in a valve body provided with three inlets configured to connect, respectively, to the first, second and third feed conduits and one outlet configured to connect to the nozzle.

* * * * *